US011284206B2

(12) United States Patent
Ji et al.

(10) Patent No.: US 11,284,206 B2
(45) Date of Patent: Mar. 22, 2022

(54) BONE CONDUCTION HEARING DEVICE

(71) Applicant: Sonitus Medical (Shanghai) Co., Ltd., Shanghai (CN)

(72) Inventors: Yang Ji, Shanghai (CN); Yuxiang Hong, Shanghai (CN)

(73) Assignee: Sonitus Medical (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/253,120

(22) PCT Filed: Sep. 20, 2018

(86) PCT No.: PCT/CN2018/106650
§ 371 (c)(1),
(2) Date: Dec. 17, 2020

(87) PCT Pub. No.: WO2020/000705
PCT Pub. Date: Jan. 2, 2020

(65) Prior Publication Data

US 2021/0266687 A1 Aug. 26, 2021

(30) Foreign Application Priority Data

Jun. 26, 2018 (CN) ..... 201820992764.7

(51) Int. Cl.
*H04R 25/00* (2006.01)

(52) U.S. Cl.
CPC ..... *H04R 25/606* (2013.01); *H04R 25/554* (2013.01); *H04R 25/602* (2013.01); *H04R 25/609* (2019.05); *H04R 2225/31* (2013.01); *H04R 2460/13* (2013.01)

(58) Field of Classification Search
CPC .... H04R 25/606; H04R 5/04; H04R 2460/13; H04R 1/24; H04R 1/26
See application file for complete search history.

(56) References Cited

U.S. PATENT DOCUMENTS

| | | | | |
|---|---|---|---|---|
| 9,398,370 | B2 * | 7/2016 | Abolfathi | B33Y 80/00 |
| 11,178,496 | B2 * | 11/2021 | Abolfathi | H04R 3/04 |
| 2009/0226011 | A1 * | 9/2009 | Abolfathi | H04R 25/606 381/151 |

FOREIGN PATENT DOCUMENTS

| | | | |
|---|---|---|---|
| CN | 2572704 | Y | 9/2003 |
| CN | 204145750 | U | 2/2015 |
| CN | 105007551 | A | 10/2015 |
| CN | 206442491 | U | 8/2017 |
| WO | WO2009025917 | A1 | 2/2009 |

* cited by examiner

*Primary Examiner* — Amir H Etesam
(74) *Attorney, Agent, or Firm* — Ling Wu; Stephen Yang; Ling and Yang Intellectual Property

(57) ABSTRACT

A bone conduction hearing device, comprising an electronic assembly, a vibration component and a battery, the battery being configured to power the electronic assembly and the vibration component, the electronic assembly being configured to control the vibration of the vibration component, and the electronic assembly and the vibration component being configured to be placed inside an accommodation space formed between at least two adjacent molars and an alveolar bone.

13 Claims, 2 Drawing Sheets

BONE CONDUCTION HEARING DEVICE

CROSS-REFERENCE TO RELATED APPLICATIONS

The present application is a U.S. National Phase Entry of International Application No. PCT/CN2018/106650 having an international filing date of Sep. 20, 2018, which claims the priority of Chinese patent application No. 201820992764.7, filed to the CNIPA on Jun. 26, 2018. The above-identified applications are incorporated into this disclosure by reference in their entireties.

TECHNICAL FIELD

This document relates to, but is not limited to, a bone conduction hearing device.

BACKGROUND

At present, there is a surgical implanted bone anchor hearing aid (BAHA) on the market, whose working principle is to convert sound into vibration and then transmit it to cochlea through skull to achieve a purpose of hearing improvement. The surgical implanted bone anchor hearing aid generally includes an electronic assembly and a vibration component, wherein the electronic assembly and the vibration component are placed outside a molar and clamp the molar to vibrate, resulting in a relatively large volume of the intraoral device (the part of the hearing aid located in the oral cavity), which affects the user's experience.

SUMMARY

The following is a summary of the subject matter described in detail in the present disclosure. This summary is not intended to limit the protection scope of the claims.

Embodiments of the present application adopt the following technical solution.

A bone conduction hearing device includes an electronic assembly, a vibration component and a battery, wherein the battery is configured to supply power to the electronic assembly and the vibration component, the electronic assembly is configured to control vibration of the vibration component, and the electronic assembly and the vibration component are configured to be placed inside an accommodation space formed between at least two adjacent molars and an alveolar bone.

Other aspects will be understood after reading and understanding the brief description of drawings and the embodiments of the present application.

Figure 1:
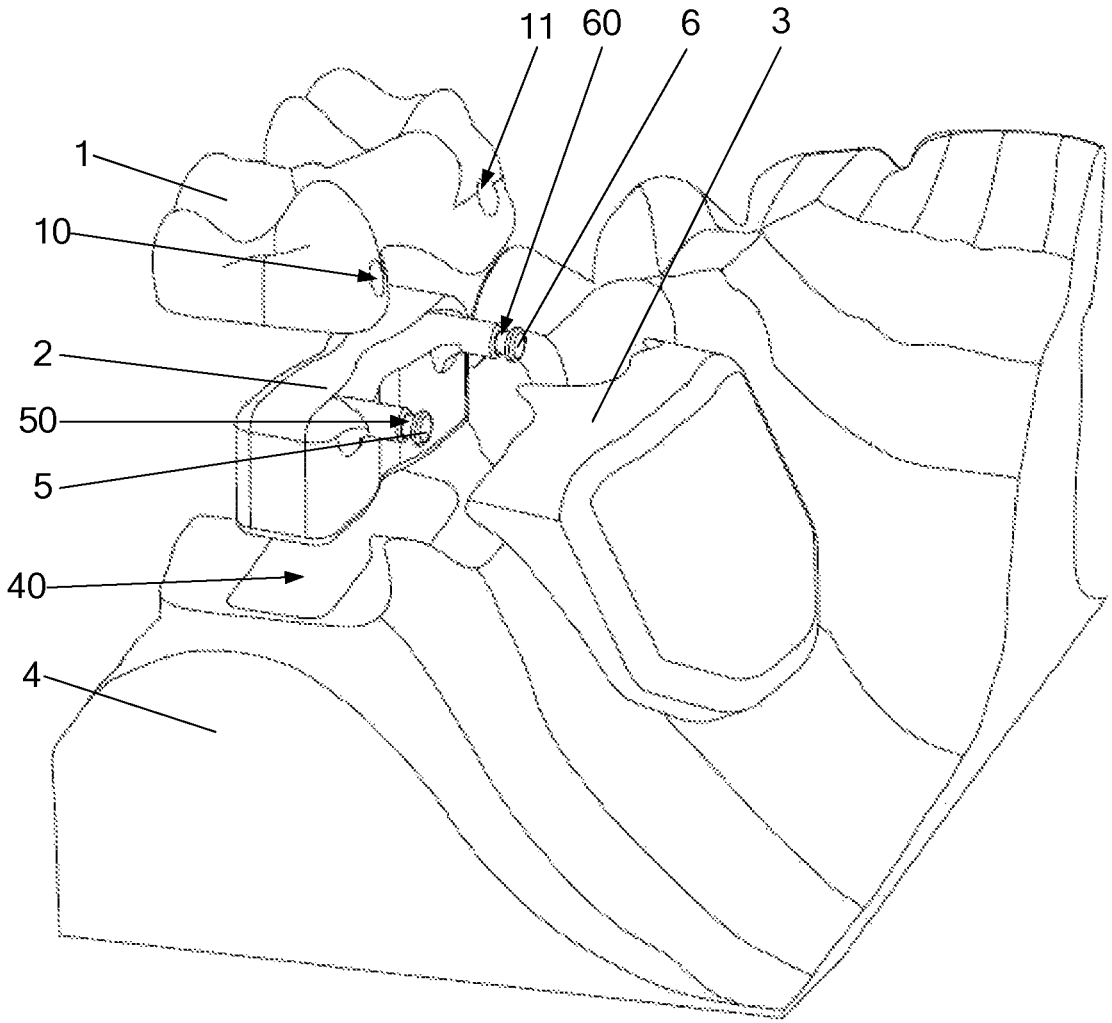
FIG. 1 is a schematic diagram of an exploded structure of a bone conduction hearing device in a use state according to an embodiment of the present application.
Figure 2:
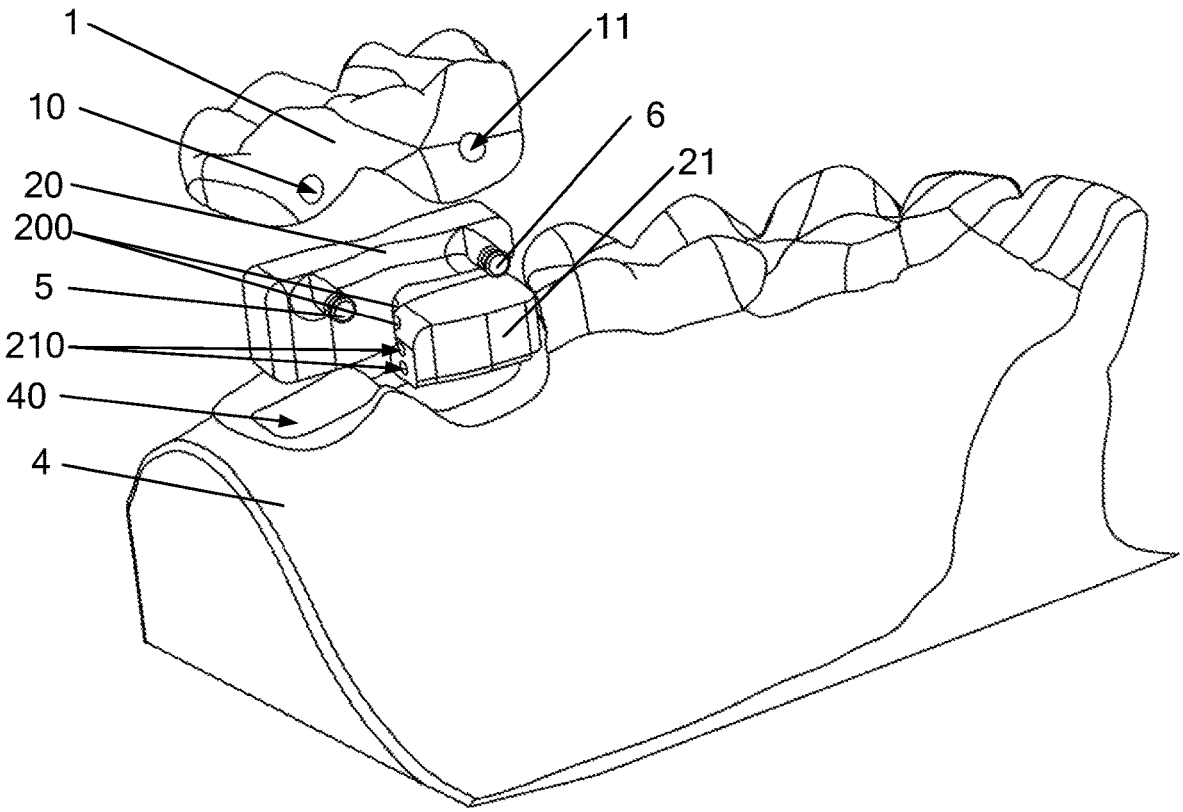
FIG. 2 is schematic diagram of an exploded structure of a bone conduction hearing device in a use state according to another embodiment of the present application, in which a battery is omitted.

Herein, the relations between reference signs and component names in FIGS. 1-2 are as follows:

1 crown, 10, 11 installation holes, 2 electronic assembly and vibration component, 20 electronic assembly, 200 PIN needle, 21 vibration component, 210 insertion hole, 3 battery, 4 alveolar bone, 40 installation cavity, 5 conduction contact, 50 snap connection port, 6 conduction contact, and 60 snap connection port.

DETAILED DESCRIPTION

Embodiments of the present application will be described in detail below with reference to the accompanying drawings. It should be noted that the embodiments in the present application and the features in the embodiments can be arbitrarily combined with each other if there is no conflict.

As shown in FIGS. 1 and 2, an embodiment of the present application provides a bone conduction hearing device, including an electronic assembly 20, a vibration component 21 and a battery 3. Here, the battery 3 serves as a power supply, which is configured to supply power to the electronic assembly 20 and the vibration component 21. The electronic assembly 20 may control vibration of the vibration component 21. The electronic assembly 20 and the vibration component 21 are configured to be placed inside an accommodation space formed between at least two adjacent molars and an alveolar bone 4.

In an embodiment, an installation space may be provided in a crown 1 of a molar, and an installation cavity 40 may be provided in the alveolar bone 4 below, wherein the installation space in the crown 1 may be matched with the installation cavity 40 on the alveolar bone 4 to form an accommodation space. Lower portions of the electronic assembly 20 and the vibration component 21 may be located in the installation cavity 40 of the alveolar bone 4, and upper portions thereof may be located in the installation space of the crown 1.

In another embodiment, the alveolar bone 4 may not be provided with an installation cavity, while only a downward opening of the installation space of the dental crown 1 is blocked.

Sealing may be made between the dental crown 1 and the alveolar bone 4 to prevent liquid and the like from entering the accommodation space.

The electronic assembly 20 may include a sensor for detecting sound and a processor. The sensor may detect sound, and the processor may receive sound signals and process the signals (such as amplifying), and control the vibration component 21 to vibrate according to the processed signals. The vibration of the vibration component 21 may be transmitted to the molar or the alveolar bone 4 and to the middle ear or inner ear of the user, so that the user can receive the sound.

By placing the electronic assembly 20 and the vibration components 21 in an accommodation space formed between the at least two adjacent molars and the alveolar bone 4, on the one hand, there is enough space to accommodate the electronic assembly 20 and the vibration component 21. On the other hand, the problems of complicated connection between the electronic assembly 20 and the vibration component 21 and complicated connection between either of the electronic assembly 20 and the vibration component 21 and the battery 3 caused by placing the electronic assembly 20 and the vibration component 21 in non-adjacent molars are avoided, and a problem of complicated sealing of the electronic assembly 20 and the vibration component 21 is avoided because there is no need to seal them separately. In addition, by placing the electronic assembly 20 and the vibration component 21 in the accommodation space formed between the at least two adjacent molars and the alveolar bone 4, it is also avoided that the volume of the intraoral device of the bone conduction hearing device located in the oral cavity is too large, which affects the user's use feeling.

In an embodiment as shown in FIG. 1, the electronic assembly and the vibration component form an integrated structure, which is indicated by reference sign 2. The integrated structure of the electronic assembly and the vibration component make the installation thereof convenient.

In an embodiment as shown in FIG. 2, the electronic assembly 20 and the vibration component 21 may have separate structures. Here, the electronic assembly 20 and the vibration component 21 may be connected by PIN needles, connected by a wire or connected wirelessly. In the embodiment shown in FIG. 2, the electronic assembly 20 is provided thereon with PIN needles 200, and the vibration component 21 is provided with insertion holes 210. The PIN needles 200 are inserted into the insertion holes 210 respectively, which may realize an electrical connection between the electronic assembly 20 and the vibration component 21, so that the connection and disassembly between the electronic assembly 20 and the vibration component 21 can be operated conveniently.

In the embodiment shown in FIGS. 1 and 2, the electronic assembly 20 and the vibration component 21 (or the integrated electronic assembly and vibration component 2) may be configured to be placed inside the accommodation space formed between the two adjacent molars and the alveolar bone 4. In other embodiments, the electronic assembly and the vibration component may be placed inside an accommodation space formed between three or more adjacent molars and the alveolar bone.

Here, the vibration component 21 may be fixedly connected with the alveolar bone 4, such as by a screw, so as to better transmit vibration to the alveolar bone 4. Alternatively, the vibration component 21 may be fixedly connected with the crown 1 of a molar, such as by adhesive connection, so as to better transmit the vibration to the molar. Alternatively, the vibration component 21 may be fixedly connected with the alveolar bone 4 and the crown 1 at the same time.

Here, the at least two adjacent molars may be dentures. In this way, the electronic assembly 20 and the vibration component 21 (or the integrated electronic assembly and vibration component 2) may be directly placed in the crown 1 of the molar during a denture implantation, thus the bone conduction hearing device may be installed without implant surgery.

In the embodiment shown in FIGS. 1 and 2, two conduction contacts 5, 6 may be formed on the electronic assembly 20 and the vibration component 21 (or the integrated electronic assembly and vibration component 2), wherein the two conduction contacts 5, 6 are configured to be both connected with the battery 3. The two conduction contacts 5, 6 are respectively a positive contact and a negative contact, which are respectively connected with positive and negative electrodes of the battery 3, so as to realize the electrical connection between the electronic assembly 20 and the vibration component 21 (or the integrated electronic assembly and vibration component 2) and the battery 3, so that the battery 3 supply power to the electronic assembly and vibration component 2.

Here, the two conduction contacts 5, 6 may be respectively provided on the electronic assembly and the vibration component, that is, one conduction contact 5 is provided on the electronic assembly and the other conduction contact 6 is provided on the vibration component, and the electronic assembly and the vibration component are electrically connected through a wire to realize a series connection of the electronic assembly and the vibration component, so as to connect the two conduction contacts 5, 6 with the positive and negative electrodes of the battery 3 respectively, thereby realizing power supply for the electronic assembly and vibration component 2.

Alternatively, the two conduction contacts 5, 6 may be provided both on the electronic assembly or both on the vibration component, and the electronic assembly and the vibration component are electrically connected by two wires. In this way, when the two conduction contacts 5, 6 are connected with the positive and negative electrodes of the battery 3 respectively, the current flows sequentially through one conduction contact (e.g., conduction contact 5), one of the electronic assembly and the vibration component, one wire, the other of the electronic assembly and the vibration component, and the other wire, and finally flows back to the battery 3 from the other conduction contact (e.g., conduction contact 6) to form a complete current loop.

Alternatively, the electronic assembly and the vibration component may be connected in parallel, both of which are connected to the two conduction contacts 5, 6.

In the embodiment shown in FIG. 2, two conduction contacts 5, 6 may be provided on the electronic assembly 20, and the electronic assembly 20 and the vibration component 21 may be connected by PIN needles.

In the above scheme, the electronic assembly and the vibration component may share the two conduction contacts 5 and 6. Of course, the electronic assembly and the vibration component may not share the conduction contacts. In this case, two conduction contacts may be provided on each of the electronic assembly and the vibration component, and then the two conduction contacts on each of the electronic assembly and the vibration component are connected with the battery respectively.

In the embodiment shown in FIG. 1, the battery 3 may be provided outside the accommodation space, which on the one hand can reduce the installation space needed in molars and improve the applicable range of the bone conduction hearing device, and on the other hand, is convenient for disassembling and replacement of the battery 3. When the battery 3 is located outside the accommodation space, in order to improve the user's comfort level, a surface of the battery 3 adjacent to the molars or the alveolar bone may be designed to fit closely with the alveolar bone or the molars, and a surface of the battery 3 away from the molars or the alveolar bone is designed to be a smooth curved surface to reduce a foreign body sensation caused by the battery 3.

In other embodiments, the battery 3 may be provided inside the accommodation space, which requires a larger installation space in this case, but can reduce the volume of the intraoral device.

Here, the battery 3 may be fixed on the alveolar bone 4, such as by a screw or snap. Alternatively, the battery 3 may be fixed on another structure or fixed by other means.

In the embodiment shown in FIGS. 1 and 2, the crowns 1 of the at least two adjacent molars are provided with two installation holes 10, 11, so that the two conduction contacts 5, 6 respectively contact with and conduct electricity from the positive and negative electrodes of the battery 3 located outside the molars through the two installation holes 10, 11.

Here, the two conduction contacts 5, 6 are detachably connected with the battery 3, so as to facilitate replacement of the battery 3 or the electronic assembly 20 or the vibration component 21 (or the integrated electronic assembly and vibration component 2).

The two conduction contacts 5, 6 and the battery 3 may be connected by screw threads or by snaps. The thread connection or snap connection has a simple connection structure, and is convenient to be disassembled and assembled. Alternatively, the battery 3 and the conduction contacts 5, 6 may be fixed by other means.

In the embodiment shown in FIG. 1, the two conduction contacts 5, 6 may be provided thereon with snap connection ports 50, 60 respectively, and the battery 3 may be provided thereon with two snaps (not shown), which may be connected with the two snap connection ports 50, 60 respectively, so as to realize the electrical connection between the battery 3 and the two conduction contacts 5, 6. The connection is firm and power failure is not easy to occur. In other embodiments, the positive and negative electrodes of the battery 3 may not be connected with the conduction contacts 5, 6, but only contact with them, and the electronic assembly and the vibration component 2 can also be powered by the battery 3.

In some embodiments, the battery 3 may be a wireless rechargeable battery or a contact rechargeable battery.

According to the bone conduction hearing device provided by the embodiments of the present application, the electronic assembly and the vibration components are small in size, and can be placed in an accommodation space formed between at least two adjacent molars and an alveolar bone, thereby reducing the size of the intraoral device and improving the user's use feeling.

What is claimed is:

1. A bone conduction hearing device, comprising an electronic assembly, a vibration component and a battery, wherein the battery is configured to supply power to the electronic assembly and the vibration component, the electronic assembly is configured to control vibration of the vibration component, and the electronic assembly and the vibration component are configured to be placed inside an accommodation space formed between at least two adjacent molars and an alveolar bone;

wherein two conduction contacts are formed on the electronic assembly and the vibration component, and the two conduction contacts are configured to contact with the battery to conduct electricity;

wherein the battery is provided outside the accommodation space.

2. The bone conduction hearing device according to claim 1, wherein the two conduction contacts are respectively provided on the electronic assembly and the vibration component, and the electronic assembly and the vibration component are electrically connected; or the two conduction contacts are both provided on the electronic assembly or on the vibration component, and the electronic assembly and the vibration component are electrically connected.

3. The bone conduction hearing device according to claim 1, wherein two installation holes are provided on the at least two adjacent molars, and the two conduction contacts respectively contact with the battery through the two installation holes to conduct electricity.

4. The bone conduction hearing device according to claim 3, wherein the two conduction contacts are detachably connected with the battery.

5. The bone conduction hearing device according to claim 4, wherein the two conduction contacts are connected with the battery by thread connection or snap connection.

6. The bone conduction hearing device according to claim 4, wherein the two conduction contacts are each provided with a snap connection port, the battery is provided with two snaps, and the two snaps are respectively connected with the two snap connection ports.

7. The bone conduction hearing device according to claim 1, wherein the electronic assembly and the vibration component are of an integrated structure or of separate structures.

8. The bone conduction hearing device according to claim 1, wherein the electronic assembly and the vibration component are of separate structures, and the electronic assembly and the vibration component are connected by PIN needles, connected by a wire, or connected wirelessly.

9. The bone conduction hearing device according to claim 1, wherein the battery is a wireless rechargeable battery or a contact rechargeable battery.

10. The bone conduction hearing device according to claim 2, wherein two installation holes are provided on the at least two adjacent molars, and the two conduction contacts respectively contact with the battery through the two installation holes to conduct electricity.

11. The bone conduction hearing device according to claim 10, wherein the two conduction contacts are detachably connected with the battery.

12. The bone conduction hearing device according to claim 11, wherein the two conduction contacts are connected with the battery by thread connection or snap connection.

13. The bone conduction hearing device according to claim 11, wherein the two conduction contacts are each provided with a snap connection port, the battery is provided with two snaps, and the two snaps are respectively connected with the two snap connection ports.

* * * * *